US005606826A

United States Patent [19]

Calhoun

[11] Patent Number: 5,606,826

[45] Date of Patent: Mar. 4, 1997

[54] DRIVE AND TRACK APPARATUS FOR VARIABLE SPEED CLOSURE

[76] Inventor: Burton B. Calhoun, 4226 Forrestar Ave., Orlando, Fla. 32806

[21] Appl. No.: 413,717

[22] Filed: Mar. 29, 1995

[51] Int. Cl.[6] ..... E05F 15/00

[52] U.S. Cl. ..... 49/138; 49/360; 49/409

[58] Field of Search ..... 49/138, 360, 409, 49/410, 411

[56] References Cited

U.S. PATENT DOCUMENTS

| | | | |
|---|---|---|---|
| 289,961 | 12/1883 | Birmingham | 49/409 X |
| 1,025,617 | 5/1912 | Elliott | 49/409 X |
| 1,834,610 | 12/1931 | Fogal . | |
| 2,458,402 | 1/1949 | Myers . | |
| 2,572,196 | 10/1951 | Raque | 49/138 |
| 2,574,496 | 11/1951 | Pomeroy et al. | 49/409 |
| 3,043,584 | 7/1962 | Kielhorn . | |
| 3,473,266 | 10/1969 | Miller | 49/409 X |
| 4,711,323 | 12/1987 | Haas | 49/360 X |
| 4,998,379 | 3/1991 | Yamada et al. . | |
| 5,046,283 | 9/1991 | Compeau et al. | 49/138 |

FOREIGN PATENT DOCUMENTS

| | | | |
|---|---|---|---|
| 1147510 | 4/1963 | Germany | 49/138 |
| 144392 | 6/1990 | Japan . | |

*Primary Examiner*—Philip C. Kannan
*Attorney, Agent, or Firm*—Allen, Dyer, Doppelt, Franjola & Milbrath, P.A.

[57] ABSTRACT

A cable drive for elevator doors has first and second drive pulleys eccentrically mounted 180° out-of-phase on the same drive motor shaft so that the cable feed rate is greater at the middle, than at the start and end of each drive cycle. Feeder pulleys arranged below the drive pulleys ensure that cable angle of feed to tension pulleys positioned at opposite ends of the door travel remains constant, regardless of rotational position of the drive pulleys. The doors travel along guide tracks provided with downwardly directed flanges, behind which upwardly directed flanges of door sheave assemblies are captured. The sheave assemblies also include downwardly directed flanges that are captured behind upwardly directed rails of the tracks. In a single-slide door or center-opening two door arrangement, each door panel has two sheave assemblies and two facing tracks are provided, the sheave of each assembly riding on a different track. This enables the tracks to be staggered to accommodate non-standard size openings.

20 Claims, 5 Drawing Sheets

DRIVE AND TRACK APPARATUS FOR VARIABLE SPEED CLOSURE

The present invention relates generally to drives and tracks for operating closures; and, more particularly, to apparatus for driving closures, such as doors of an elevator cab or the like, at variable speeds along a track under motive force imparted by a cable.

BACKGROUND OF THE INVENTION

Elevator doors and similar closures are operated along tracks at variable speeds, so that the beginning and end of travel occur at slower speeds than the middle of travel. Typically, this is achieved using a variable speed motor and providing limit switches at extremes of door travel to turn the motor off.

There are various known ways of achieving a variable speed output for driving closures. Such mechanisms can be broadly grouped into four types: those employing meshing eccentric gears or cam surfaces; those utilizing stepped or variable diameter shafts; those employing eccentric sprockets or wheels for driving chains or belts; and other miscellaneous types.

U.S. Pat. Nos. 1,834,610 and 4,998,379 and Japanese Patent No. 144,392 show mechanisms for converting constant speed rotation into variable speed rotation utilizing meshing eccentric gears or cams. In the '610 patent, a driving gear eccentrically mounted on a drive shaft is rotated in mesh with a driven gear eccentrically mounted on a driven shaft, to rotate the drive shaft at varying speeds. At the start, door movement is slow, then accelerates, and is finally retarded again as the doors are moved into the closed position. A similar mechanism is employed in the Japanese patent. There, a non-circular drive gear is rotated by a constant velocity input shaft to drive a 180° oppositely oriented similar non-circular driven gear, to periodically change the rotation speed of an output shaft between a maximum and a minimum. The '379 patent employs similar principles in a vehicle window regulator, wherein two elliptical gears are peripherally meshed to define a varying radius about an axis of rotation, so that a window travels at a faster speed near its fully closed position than when near its fully opened position.

Examples of variable speed drives employing stepped or variable diameter shafts are given in U.S. Pat. Nos. 3,043,584 and 5,046,283. In the '584 patent, a constant speed, continuously variable diameter cone is used to frictionally drive a rail which engages the cone at different diameters at different times during a door panel opening or closing procedure. A point at the periphery of the cone near the apex travels at measurably slower speed than a point near the base of the cone, so that the rail contacting the cone first at one and then at the other point will be propelled successively at slower, then higher, speeds. In a van door closing arrangement described in the '283 patent, for a motor turning at constant speed, the winding of a cable on a larger diameter portion of a reel causes a door to travel at a relatively high speed over large distance. Then, as the door approaches the closed position, the winding of the cable on a smaller diameter portion of the same reel causes the door to move at a slower speed, but with a greater force being applied to the cable, until the door is fully closed.

German Auslegeschrift 1,147,510 shows an arrangement for opening and closing doors that utilizes an eccentrically mounted input sprocket, rotating at constant velocity on an shaft, to drive a chain to turn a circular output sprocket at varying speeds. Slack in the chain due to varying radius of the input sprocket relative to the input shaft is taken up either by a spring-loaded auxiliary sprocket, or by another eccentric member, whose rotation is coordinated with the rotation of the input sprocket.

Other prior art arrangements for accomplishing door closure are given in U.S. Pat. Nos. 2,458,402 and 4,711,323.

Conventional elevator doors are suspended from movable sheave assemblies that roll along tracks attached to the cab, above the cab opening. Connection between the output of the drive motor and the sheaves is established either by cable connection or mechanical linkage. In a typical cable connection, a variable speed electric motor is mounted atop the cab and powered by a long flexible power line having one end connected to travel with the cab and the other end connected to a power control system fixed atop the hoistway. The sheave assemblies are connected to be drawn along the track by a cable that is driven by the motor and has a run disposed parallel with, and above, the track. For a single-slide door arrangement, one or both sheave assemblies are clamped to move the door from its closed to its open position, and back, at speeds and torques determined in compliance with applicable elevator codes (e.g. Elevator Code A17.1 or European Code EN 81). In a center-opening, two door arrangement, the driving run of cable usually takes the form of a loop of cable having two spaced, oppositely directed runs. The sheaves of one door are clamped to travel in one direction with one run and the sheaves of the other door are clamped to travel in the opposite direction with the other run. Two-speed slide door arrangements, having slow and fast doors arranged in pairs, connect in similar fashion, except that a traveling gearing bar assembly is interposed between the sheaves of each pair and the drive cable. The gearing bar assembly comprises a bar clamped to move with the main drive cable, and a secondary loop of cable which winds around opposite gearing pulleys and has one run clamped to the cab. The "fast" door is fixed to the bar, so travels with the bar and primary cable. The "slow" door, however, is fixed to the other run of the secondary loop, so travels at half the speed for half the distance.

Existing door tracks having C-shaped cross-sections provide inwardly-facing, upper and lower rails between which centrally grooved sheaves of the sheave assemblies are captured. Smaller eccentric rollers travel along the undersurface of the track to maintain stability. To hang the doors, the sheaves must be slid in from the ends of the track, which may be difficult to do in confined spaces. Further, because the sheaves of all sheave assemblies for each door ride on the same track, track lengths are difficult to fit for nonstandard cab or opening widths and must often be special ordered from the fabricator at customized sizes.

SUMMARY OF THE INVENTION

It is an object of the present invention to provide a novel variable speed cable drive, suitable for use in operating elevator doors and similar closures.

It is another object of the invention to provide an improved guide track assembly for a hanging closure panel, suitable for use with elevator doors and similar closures.

It is a further object of the invention to provide an elevator door closure, or the like, incorporating such improved drive and track mechanism.

In accordance with one aspect of the invention, a drive suitable for operating an elevator door or similar closure utilizes a cable wrapped around a dual eccentric drive pulley arrangement to vary travel speed of a movable closure panel. This feature can be used with or without additional control provided by variation in motor speed. The dual eccentric arrangement is configured so that it feeds and takes in more cable per unit time in the middle of each drive cycle, and less cable at the beginning and end of the cycle. Such arrangement ensures that, as more cable is wrapped by the one pulley, the other makes more cable available. In a preferred embodiment, described in greater detail below, first and second drive pulleys are eccentrically mounted 180° out-of-phase on the same drive motor output shaft. Feeder pulleys are arranged below the drive pulleys, so that angle of feed to tension pulleys positioned at opposite ends of the travel-defining run of cable remains the same, regardless of angular orientation of the drive pulleys.

In accordance with another aspect of the invention, guide tracks along which the sheave assemblies of suspended elevator door panels or similar closures travel are provided with downwardly directed flanges, behind which upwardly directed flanges of the sheave assemblies are captured. The sheave assemblies also include downwardly directed flanges that are captured behind an upwardly directed rail of the track. The keeper arrangement ensures that the sheaves stay on the rail, without the necessity to provide a vertically spaced, opposing rail on each track, and without the necessity to mount the closures from the ends of the track. In a single-slide door or center-opening two door arrangement, each panel has two sheave assemblies and two facing tracks are provided, the sheave of each assembly riding on a different track. This enables the tracks to be staggered if necessary to accommodate non-standard size openings for width differences falling within the spacing the sheaves.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
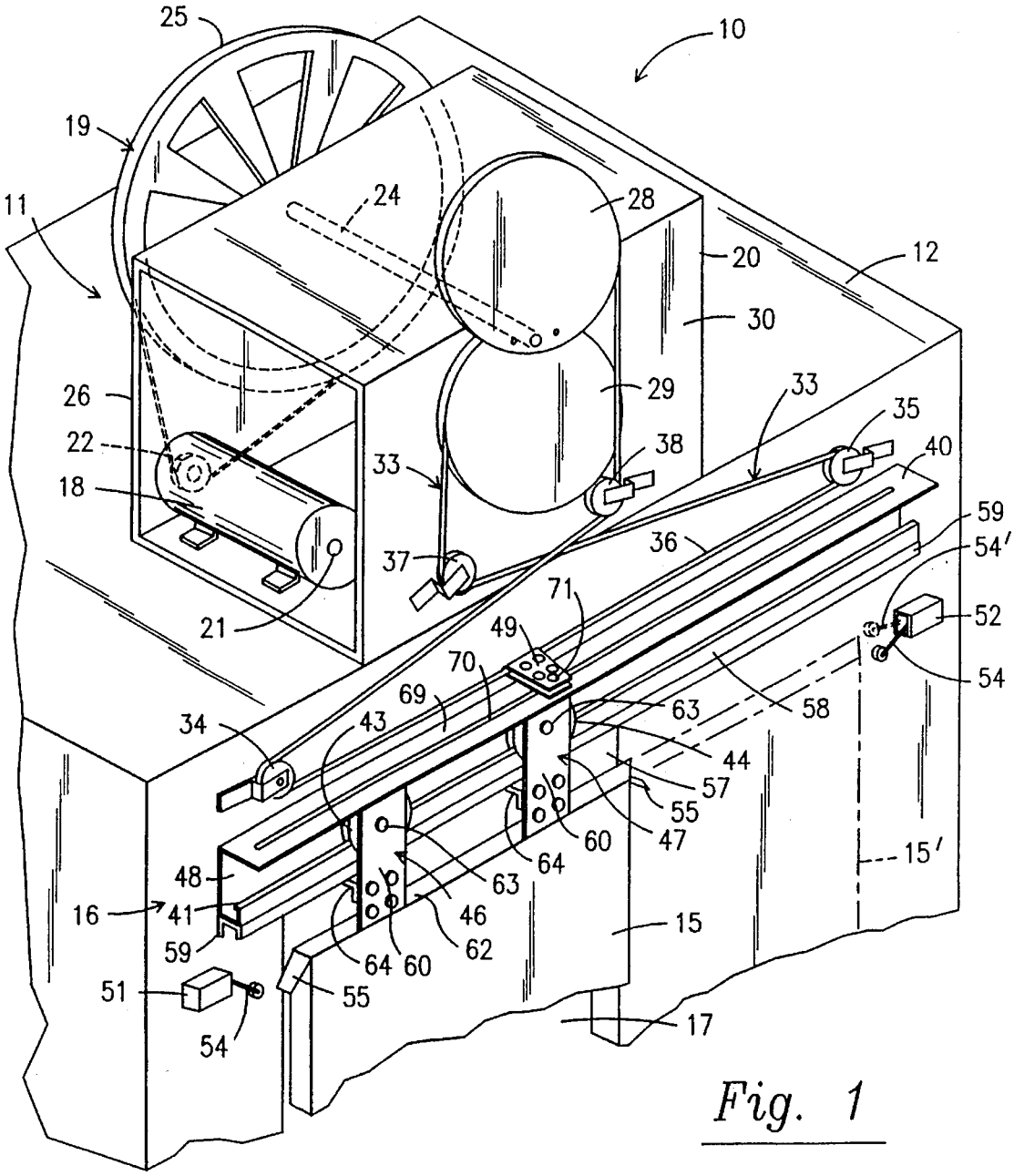
FIG. 1 is a perspective view of an elevator door closure utilizing a variable speed drive, in accordance with the invention.

An exemplary implementation of a drive apparatus 10 in accordance with the invention is shown in FIG. 1. Apparatus 10, includes an actuator 11 positioned atop an elevator cab 12 and comprising means for driving a cable to move an elevator door 15 at variable speed along a track assembly 16, into and away from a blocking position relative to an interior access opening 17 of cab 12.

Actuator 11 has a constant speed DC electric motor 18 and a motor output transmission mechanism 19 mounted on a housing framework 20 for movement within an elevator shaft together with the associated cab 12. Though a constant speed motor is used for purposes of illustration, it should be recognized that additional control can be realized, if desired, through use of a variable speed motor. Motor 18 has an output shaft 21 to one end of which is attached a pulley 22. Transmission 19 comprises a second shaft 24, extending longitudinally parallel to and displaced from shaft 21 and journalled for rotation relative to structure 20. A pulley 25 is attached for rotation on a first end of shaft 24 that projects outwardly from a vertical wall 26 of structure 20. A cable 27 is wrapped in a loop circumferentially around peripheral grooves of pulleys 22, 25, with pulley 25 having a radius substantially greater than that of pulley 22. In this manner, pulleys 22, 25 and cable 27 define a speed reduction assembly for driving drive shaft 24 at a constant rotational speed, less than a constant rotational speed of motor shaft 21. The speed reduction relationship is determined in accordance with well-known principles and is a function of the ratio of the relative radii of pulleys 22, 25.

A pair of drive pulleys 28, 29 are eccentrically mounted for rotation with an opposite end of shaft 24 that projects outwardly from an opposing wall 30 of structure 20. Pulleys 28, 29 are two equal circular sheaves mounted eccentrically in 180° out-of-phase relationships to each other and to torque shaft 24. The working circumference of sheaves 28, 29 is generally equal to two-thirds the distance through which door 15 is to be moved along track assembly 16. A cable 33 has one end wrapped around pulley 28 in a first direction and the other end wrapped around pulley 29 in an opposite direction. The ends of cable 33 are respectively fixed to the pulleys 28, 29 and the cumulative total of the length of cable wrapped around both sheaves at any one time is greater than one and one-half times the circumference of one of the pulleys 28, 29.

An intermediate portion of cable 33 passes around a pair of spaced tension pulleys 34, 35 located on the front of cab 12 proximate opposite ends of track assembly 16. A run 36 of cable 33 is defined between pulleys 34, 35 which is parallel to and located above track assembly 16. Feeder pulleys 37, 38 are located between tension pulleys 34, 35 and drive pulleys 28, 29. Pulleys 37, 38 define fixed positions for feeding the intermediate portion of cable 33 from the respective pulleys 28, 29 to the tension pulleys 34, 35. Pulleys 37, 38 are aligned horizontally and located so that cable 33 will feed vertically between pulleys 28, 29 and pulleys 37, 38, when pulleys 28, 29 are in vertically aligned positions, one above the other. All pulleys 34, 35, 37, 38 may take the form of conventional tension pulley assemblies. All cables may take the form of 8×19 steel cable. The term "cable" is intended to encompass chains, belts, and similar flexible linear elements which may be used for the same door driving purpose. Other arrangements, such as direct reduction gearing, can be substituted for the pulleys 22, 25 and cable 27 arrangement described to produce rotational drive of pulleys 28, 29 at the output of shaft 24.

Track assembly 16 comprises an elongated beam 40 of C-shaped cross-section, stretching horizontally across the front of cab 12, above cab opening 17. Beam 40 includes an upwardly directed, inwardly turned front edge flange which defines a rail 41 onto which rolling sheave elements 43, 44 of door supporting sheave assemblies 46, 47 are received. A base plate portion 48 of beam 40 is attached to the front of cab 12. At least one of assemblies 46, 47 is fixed by a clamp assembly 49 to cable 33 at a point along run 36 which runs above and parallel to beam 40. Beam 40 is dimensioned and configured so that rail 41 is sufficiently long to accommodate the full length of travel of door 15 during opening and closing cycles. Run 36 and clamp 49 are positioned to accommodate the full length of travel of door 15.

The operation of drive apparatus 11 is illustrated with reference to FIGS. 2 and 3.

Figure 2:
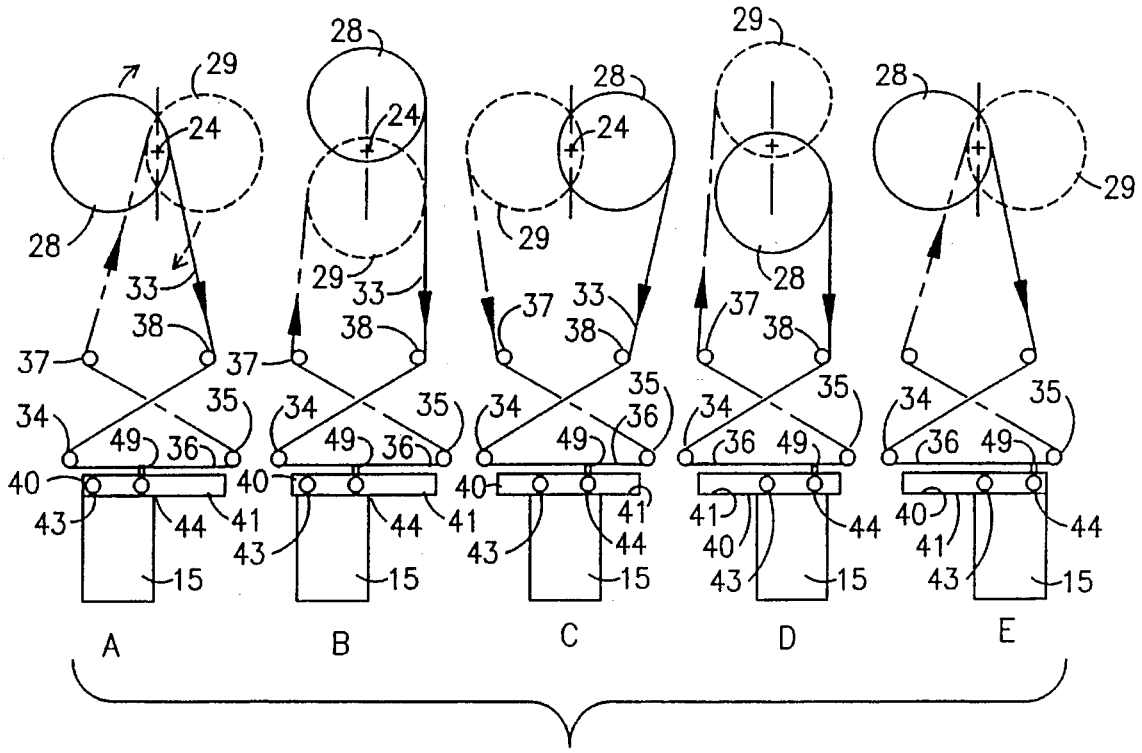
FIG. 2 is a schematic view showing successive steps A through E in operation of the drive of FIG. 1.

Door 15 is hung by sheave assemblies 46, 47 on rail 41, and clamp 49 is attached relative to cable 33, so that door 15 will be in a "closed" or blocking position relative to opening 17 when shaft 24 is rotated to bring drive pulleys 28, 29 into their initial horizontally aligned positions shown at time A in FIG. 2. For the illustrated embodiment, this places pulley 28 on the left and pulley 29 on the right. The pulleys have approximately 60° overlapping arcs, and the rotational axis of shaft 24 extends perpendicular, centrally of the overlap. Cable 33 feeds tangentially from the right side of pulley 28 down and to the right, to wind around the right side of feeder pulley 38. From there, cable 33 feeds tangentially down and to the left, to wind around the left side of tension pulley 34. Cable 33 then stretches horizontally across the run 36, from the bottom of tension pulley 34 to the bottom of tension pulley 35. On the retrieval side, cable 33 winds around the right side of pulley 35, tangentially up and to the left, to the left side of feeder pulley 37. It then extends tangentially up and to the right, to the left side of drive pulley 29. The angling between pulleys 37, 38 and pulleys 34, 35, as well as the horizontal length of run 36, remain constant throughout the door opening and door closing drive cycles. However, the rates of feed and retrieval of cable 33 relative to pulleys 28, 29, and the points of tangency for the runs between pulleys 28, 29 and 37, 38, change as the angular orientation of the dual eccentric arrangement of pulleys 28, 29 changes with rotation of shaft 24.

Viewed from the front of cab 12, shaft 24 is rotated clockwise throughout the door opening cycle, under torque supplied by motor 18. As shaft 24 turns through one revolution, the orientations of pulleys 28, 29 change and the position of door 15 change as indicated by the successive schematic representations A through E in FIG. 2. At the beginning of the cycle (time A), door 15 covers opening 17 and clamp 49 is in its leftmost position on cable run 36. As the dual eccentric arrangement of pulleys 28, 29 begins to rotate clockwise with shaft 24, door speed is at a minimum and torque is at a maximum, as indicated in FIG. 3. One quarter of the way through the cycle (time B), pulleys 28, 29 have rotated into the vertically aligned position shown, and the rate of feed (length per unit time) of cable 33 off pulley 28 has picked up, increasing door speed and decreasing torque. The time B position is also the one shown in FIG. 1. Because of the tandem 180° out-of-phase relationship of pulleys 28, 29, pulley 29 has shifted so that the rate of retrieval of cable 33 onto pulley 29 has correspondingly increased to compensate for the increase in feed rate, thereby maintaining the tension across run 36 constant.

Figure 3:
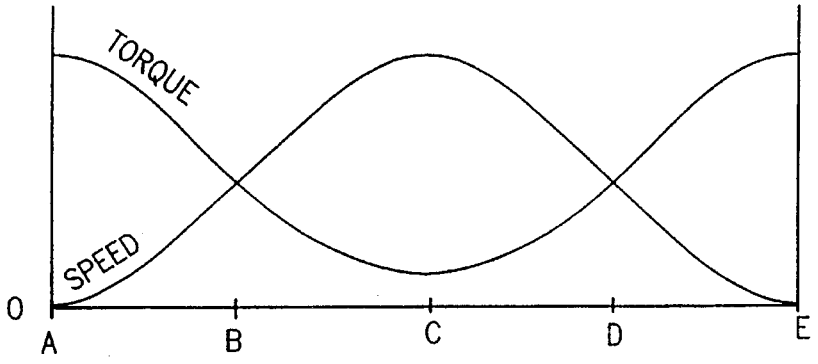
FIG. 3 is a graphical representation of time variations of torque and speed over the drive cycle shown in FIG. 2.

As the opening cycle continues to time C, clamp 49 (and, thus, door 15) is further shifted to the right, with the rate of feed off cable 33 (and, thus, speed of travel of door 15) reaching a maximum as shown in FIG. 3. The torque has, meanwhile, reached a corresponding minimum. As the opening cycle goes through time D, feed rate off pulley 28 decreases and torque increases again, until the end of the opening cycle is reached at time E, and clamp 49 has moved door 15 to its extreme open position 15' (indicated by dot-dashed lines in FIG. 1). The closing cycle is the reverse of the opening cycle, going through the same steps A through E in opposite sequence. The working circumferences of pulleys 28, 29 are chosen so that the cable wraps 1.5 times about the circumference of take-up pulley 29 during travel between door closed and door open positions, and wraps an equal amount around pulley 28 between door open and door closed positions on the return trip.

Limit switches 51, 52, electrically connected to motor 18, are provided in accordance with known principles to deenergize motor 18 when door 15 reaches the extremes of its open and closed positions. In the shown embodiment, switches 51, 52 include oppositely facing roller arms 54 located to interact with opposite slanted ramps 55 located on the leading and trailing edges of the top of door 15. Thus, for the opening cycle, when door 15 reaches its fully opened position 15' shown in FIG. 1, roller arm 54 has been raised into its motor stopping position 54'. Limit switches 51, 52 could just as well have been located to interact with pins mounted on one of the rotating elements of drive 11.

Details of the track assembly are illustrated with reference to embodiments thereof shown in FIGS. 1, 4–5 and 6–7.

As already described, track assembly 16 has a beam 40 extended widthwise across the front of cab 12. Beam 40 includes an upwardly turned flange;along its forward edge that defines a rail 41 along which sheaves 43, 44 of door sheave assemblies 46, 47 travel. In accordance with a feature of the invention, a downwardly turned flange 58 is defined in general vertical alignment with rail 41, by an inverted U-shaped channel member 59 attached to the underside of beam 40 for the full length of rail 41. Each sheave assembly 46, 47 includes a support plate 60 having a lower end secured to an upright leg of an angled mounting bracket 62 fixed to the top of door 15, and a top end to which the associated traveling sheave 43, 44 is journalled for rotation about a shaft 63 (see FIGS. 5, 7). An angled keeper member 64 is secured to an intermediate portion of each plate 60, to present an upwardly directed flange 65 within the confines of the downwardly open channel of member 59. In addition, each sheave assembly 46, 47 includes a follower plate 67, parallel to and located on an opposite side of sheave 43, 44 of plate 60, which is generally upwardly directed, but includes a depending edge portion 68 received within the confines of the channel defined in beam 40 between rail 41 and base plate portion 48 (see FIGS. 5 and 7). Flanges 65, 68, captured within their respective channels, serve to ensure that sheaves 43, 44 stay on the rail 41. Because keeper angle 64 can be secured to plate 60 after mounting sheaves 43, 44, door 15 can be hung onto or removed from beam 40, without the need to remove sheave assemblies 46, 47 and without having to slide the sheaves from the beam ends.

For the single-slide door arrangement of FIG. 1, both sheave assemblies 46, 47 are faced toward the front of cab 12, and both ride the same rail 41. The top of beam 40 includes a forwardly directed header plate portion 69 having a central longitudinal slit 70 through which a bolt 71 can be passed to connect clamp assembly 49 to one or both sheave assemblies 46, 7, or directly to door 15.

Figure 4:
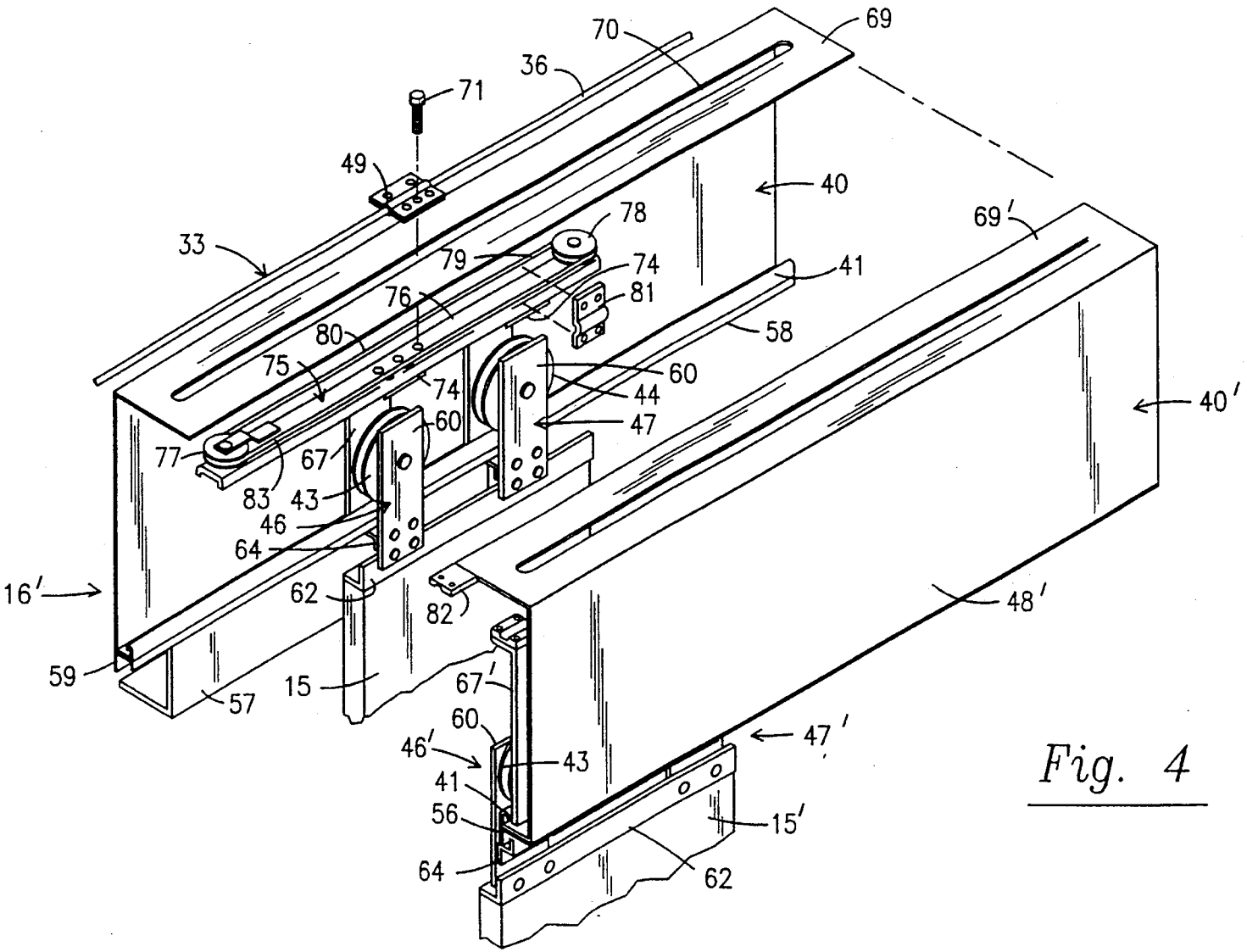
FIG. 4 is an exploded view of a track arrangement of the invention usable with the drive of FIG. 1.
Figure 5:
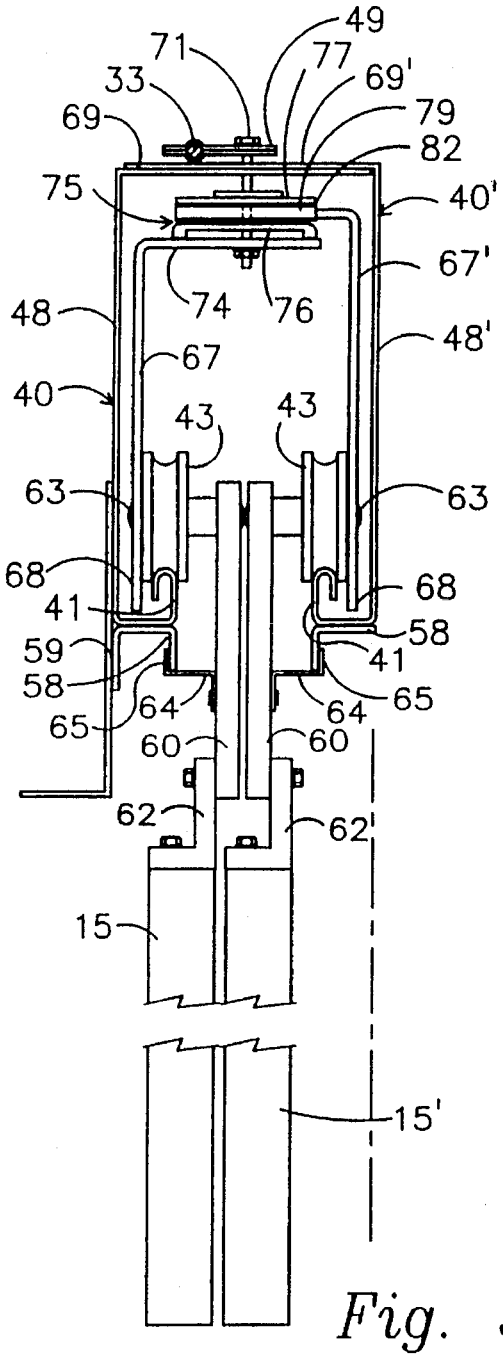
FIG. 5 is a lateral end view of the arrangement of FIG. 4.

FIGS. 4 and 5 illustrate a two-speed slide arrangement, wherein a first "low speed" door 15 is mounted on a first beam 40 adjacent the cab, and a second "high speed" door 15 is mounted in a mirror image configuration on a second beam 40', whose base plate portion 48' is spaced out from base plate portion 48 of beam 40 and whose header plate portion 69' is secured in alignment onto header plate portion 69, as shown in FIGS. 4 and 5. The upper end of plate 67 of one or both sheave assemblies 46, 47 of door 15 is provided with a forwardly facing header portion 74 that secures to the underside of a gearing bar assembly 75 to which the bolt 71 is attached. Assembly 75 comprises an elongated bar 76 having an upper surface with opposite ends respectively accommodated with horizontally disposed gearing pulleys 77, 78. A cable 79 is looped around pulleys 77, 78 and a rearward run 80 of cable 79 is clamped by means of a clamping bracket 81 to the forwardly facing surface of base plate portion 48 of beam 40. An upper end of one or both follower plates 67' of the corresponding mirror image sheave assemblies 46', 47' of the high speed door 15' is attached by means of a clamping bracket 82 to a horizontally displaced point on a forward run 83 of cable loop 79. Thus, as cable run 36 moves from left to right (or right to left) relative to beams 40, 40', clamp 49 tows bar 76 to which sheave assemblies 46, 47 of the low speed door 15 are attached, to move the low speed door 15 a corresponding equal distance in the same direction. Gearing bar assembly 75, however, functions so that high speed door 15' is simultaneously moved a greater distance in the same direction. Door 15' is not only moved together with bar 76, but it is also moved relative to bar 82 by attachment at 82 to the advancing forward run 83 of cable loop 79, whose rear run 80 is clamped to beam 40 at 81.

Figure 7:
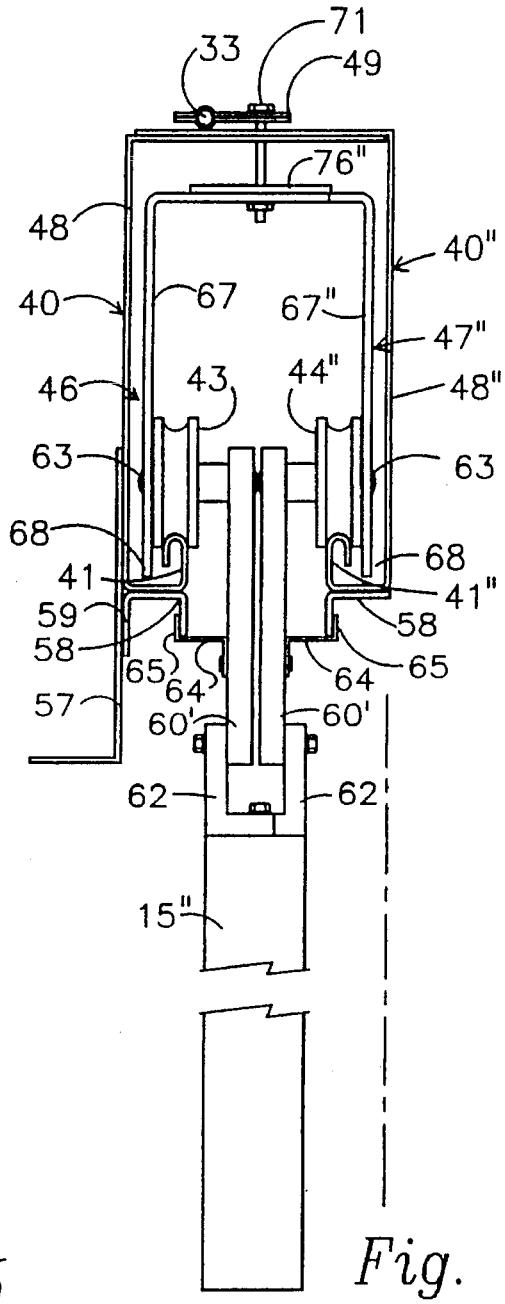
FIGS. 6 and 7 are views, similar to those of FIGS. 4 and 5, of an alternative track arrangement.
Figure 6:
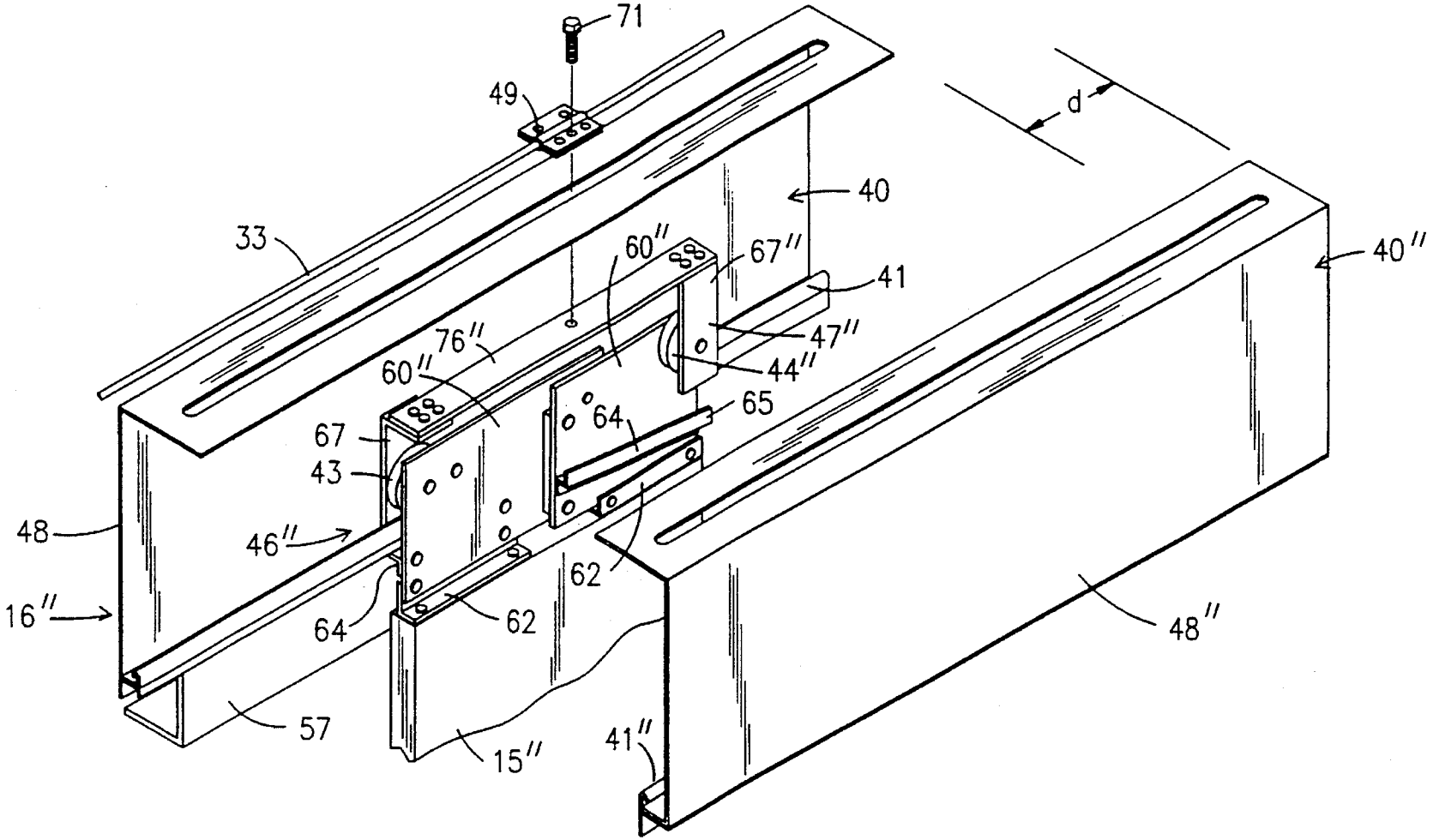

FIGS. 6–7 illustrate a modification of the single-slide door arrangement of FIG. 1, wherein the configuration of sheave assembly 47 is reversed in sheave assembly 47", so that a first sheave 43 rides on track 41 of beam 40, as before; but a second sheave 44" of the same door 15" rides on a rail 41" of a second beam 40" having a base plate portion 48" spaced outwardly from base plate portion 48 of beam 40. A bar 76" connects the tops of follower plates 67, 67" with the travelling clamp assembly 49, through bolt 71. The FIGS. 6–7 arrangement, which has sheave 43 on one rail 41 and sheave 44" on another rail 41" has the advantage that longitudinal shifting of one beam 40" relative to the other beam 40 by a displacement d within the limits of the distance separating sheaves 43", 44", enables length adjustment of track assembly 16" to match non-standard widths of cabs 12 or openings 17.

FIG. 6 shows an extended double-sheave support plate 60" which can be used on each door 15, 15' in place of the two separate single-sheave support plates 60 shown in the arrangements of FIG. 1 and FIGS. 4 and 5. In such case, each plate 60" will carry two sheaves 46, 47 or 46', 47'. When used on the longer single-slide door 15", however two oppositely facing plates 60" can be overlapped and bolted together to match the sizing of door 15", with each plate 60" carrying only one sheave 43 or 44", as illustrated.

Those skilled in the art to which the invention relates will appreciate that other substitutions and modifications can be made to the described embodiments, without departing from the spirit and scope of the invention as described by the claims below.

What is claimed is:

1. Drive and track apparatus for a variable speed closure, comprising:

a track assembly defining a run with opposite ends;

a closure member movably mounted on said track assembly;

a motor;

a shaft connected for rotation by said motor;

first and second drive pulleys eccentrically mounted in 180° out-of-phase relationships for rotation with said shaft;

first and second tension pulleys respectively located proximate said run ends;

first and second feeder pulleys respectively located between said tension pulleys and said drive pulleys;

a cable having one end wrapped around said first drive pulley, another end wrapped around said second drive pulley, and an intermediate portion wrapped around said tension and feeder pulleys; said feeder pulleys serving to establish fixed positions for feeding said intermediate portion of said cable between said drive pulleys and said tension pulleys; and means connecting said closure member for travel with said cable intermediate portion.

2. Apparatus as in claim 1, wherein said drive pulleys are equal circular sheaves; and said cable is wrapped in a given direction around said first drive pulley and in an opposite direction around said second drive pulley.

3. Apparatus as in claim 2, wherein said equal sheaves have a circumference about which said cable is wrapped; and wherein the cumulative total of the length of cable wrapped around both sheaves at any one time is greater than one and one-half times said circumference.

4. Apparatus as in claim 1, wherein rotation of said shaft will bring said drive pulleys into vertically aligned positions, one above the other; said run is a horizontal run; and said feeder pulleys are aligned horizontally and located so that said cable will feed vertically between said drive pulleys and said feeder pulleys when said driver pulleys are brought into said vertically aligned positions.

5. Apparatus as in claim 1, wherein said first and second drive pulleys are equal circular pulleys with approximately 60° overlapping arcs.

6. Apparatus as in claim 1, wherein said closure member comprises a door, and at least one sheave assembly mounting said door on said track assembly; and wherein said means connecting said closure member for travel with said cable intermediate portion comprises a clamp, clamping said at least one sheave assembly to said cable.

7. Apparatus as in claims 6, wherein said track assembly comprises first and second tracks; said at least one sheave assembly mounts said door on said first track; and said apparatus further comprises a second door, at least one second sheave assembly mounting said second door on said second track, and means connecting said second door for travel with said cable intermediate portion.

8. Apparatus as in claim 7, wherein said means connecting said second door for travel with said cable intermediate portion comprises first and second gearing pulleys attached to said first door, a second cable wrapped around said gearing pulleys, means fixing said second cable relative to said run, and means connecting said second door for travel with said second cable.

9. Apparatus as in claim 1, wherein said closure member comprises a door, and first and second sheave assemblies mounting said door on said track assembly; said track assembly comprises first and second tracks; said first sheave assembly mounts said door on said first track; and said second sheave assembly mounts said door on said second track.

10. Apparatus as in claim 1, wherein said shaft is a drive shaft; said apparatus further comprises a motor shaft, and a speed reduction assembly for rotating said drive shaft with said motor shaft; and said drive pulleys are mounted on said drive shaft.

11. Drive and track apparatus for a variable speed closure, comprising:

a track assembly;

a closure member mounted on said track assembly; and means for driving said closure member along said track assembly;

said track assembly including an upwardly directed rail and a downwardly directed flange; and said closure member including a sheave assembly with a rolling element movably mounted on said rail, an upwardly directed flange captured by said track assembly downwardly directed flange, and a downwardly directed flange captured by said rail for insuring that said element remains on said upwardly directed rail.

12. Apparatus as in claim 11, wherein said track assembly comprises a beam having a base plate portion and an upwardly turned flange spaced from said base portion, said beam upwardly turned flange defining said rail; and said sheave assembly includes a support plate, a follower plate, and means mounting said rolling element between said support plate and said follower plate, said sheave assembly downwardly directed flange being located on said follower plate and being captured between said base plate portion and said rail.

13. Apparatus as in claim 12, wherein said sheave assembly includes an angled keeper member secured to said support plate below said roller element; said sheave assembly upwardly directed flange being located on said keeper member.

14. Apparatus as in claim 11, wherein said track assembly downwardly turned flange is in general vertical alignment with said rail.

15. Drive and track apparatus for a variable speed closure, comprising:

a track assembly defining a run with opposite ends; said track assembly including an upwardly directed rail and a downwardly directed flange;

a closure member including a sheave assembly with a rolling element movably mounted on said rail, an upwardly directed flange captured by said track assembly downwardly directed flange, and a downwardly directed flange captured by said rail;

a motor;

a shaft connected for rotation by said motor;

first and second drive pulleys eccentrically mounted in 180° out-of-phase relationships for rotation with said shaft;

first and second tension pulleys respectively located proximate said run ends;

first and second feeder pulleys respectively located between said tension pulleys and said drive pulleys;

a cable having one end wrapped around said first drive pulley, another end wrapped around said second drive pulley, and an intermediate portion wrapped around said tension and feeder pulleys; said feeder pulleys serving to establish fixed positions for feeding said intermediate portion of said cable between said drive pulleys and said tension pulleys; and means connecting said closure member for travel with said cable intermediate portion.

16. Apparatus as in claim 15, wherein said drive pulleys are equal circular sheaves; and said cable is wrapped in a given direction around said first drive pulley and in an opposite direction around said second drive pulley.

17. Apparatus as in claim 16, wherein rotation of said shaft will bring said drive pulley sheaves into vertically aligned positions, one above the other; said run is a horizontal run; and said feeder pulleys are aligned horizontally and located so that said cable will feed vertically between said drive pulley sheaves and said feeder pulleys, when said driver pulley sheaves are brought into said vertically aligned positions.

18. Apparatus as in claim 17, wherein said track assembly comprises a beam having a base plate portion and an upwardly turned flange spaced from said base portion, said beam upwardly turned flange defining said rail; and said sheave assembly includes a support plate, a follower plate, and means mounting said rolling element between said support plate and said follower plate, said sheave assembly downwardly directed flange being located on said follower plate and being captured between said base plate portion and said rail.

19. Apparatus as in claim 18, wherein said track assembly comprises first and second tracks; said at least one sheave assembly mounts said door on said first track; said means connecting said closure member for travel with said cable intermediate portion comprises a clamp, clamping said at least one sheave assembly to said cable; and said apparatus further comprises a second door, at least one second sheave assembly mounting said second door on said second track, first and second gearing pulleys attached to said first door, a second cable wrapped around said gearing pulleys, means fixing said second cable relative to said run, and means connecting said second door for travel with said second cable.

20. Apparatus as in claim 18, wherein said closure member comprises a door, and first and second sheave assemblies mounting said door on said track assembly; said track assembly comprises first and second tracks; said first sheave assembly mounts said door on said first track; and said second sheave assembly mounts said door on said second track.

* * * * *